US007148602B2

(12) United States Patent
Suzuki et al.

(10) Patent No.: US 7,148,602 B2
(45) Date of Patent: Dec. 12, 2006

(54) COMMUTATOR

(75) Inventors: Shinichi Suzuki, Kagawa (JP); Fumihiro Hozumi, Kagawa (JP); Daisuke Namikoshi, Kagawa (JP)

(73) Assignee: Totankako Co., Ltd., Osaka (JP)

( * ) Notice: Subject to any disclaimer, the term of this patent is extended or adjusted under 35 U.S.C. 154(b) by 0 days.

(21) Appl. No.: 10/981,187

(22) Filed: Nov. 4, 2004

(65) Prior Publication Data

US 2005/0099088 A1 May 12, 2005

(30) Foreign Application Priority Data

Nov. 7, 2003 (JP) ..... 2003-377766

(51) Int. Cl.
*H01R 43/06* (2006.01)
*H01R 39/04* (2006.01)

(52) U.S. Cl. ..... 310/233; 310/237

(58) Field of Classification Search ..... 310/233, 310/235, 236, 237; 428/64.1, 658, 548, 552; 419/6, 52; 524/594; 252/502, 511
See application file for complete search history.

(56) References Cited

U.S. PATENT DOCUMENTS

| | | | | |
|---|---|---|---|---|
| 3,509,400 | A * | 4/1970 | Conrath | 310/248 |
| 4,349,384 | A * | 9/1982 | Weinert | 419/6 |
| 5,175,463 | A | 12/1992 | Farago et al. | |
| 6,114,791 | A | 9/2000 | Ito et al. | |
| 6,222,298 | B1 * | 4/2001 | Saito et al. | 310/233 |
| 2002/0172856 | A1 * | 11/2002 | Mercuri | 429/44 |
| 2005/0084642 | A1 * | 4/2005 | Arnold et al. | 428/64.1 |

FOREIGN PATENT DOCUMENTS

| | | | |
|---|---|---|---|
| JP | 56-132785 A | | 10/1981 |
| JP | 62059509 A | * | 3/1987 |
| JP | 63-073849 A | | 4/1988 |
| JP | 01-222641 A | | 5/1989 |
| JP | 02-151244 A | | 11/1990 |
| JP | 03-252357 A | | 11/1991 |
| JP | 04-0305083 | | 10/1992 |
| JP | 05-030710 | | 2/1993 |
| JP | 05-234653 | | 9/1993 |
| JP | 07-264812 | | 10/1995 |
| JP | 08-126259 | | 5/1996 |
| JP | 08-308183 | | 11/1996 |
| JP | 10-004653 | | 1/1998 |
| JP | 10-162923 | | 6/1998 |
| JP | 410228895 | * | 8/1998 |
| JP | 11-055904 | | 2/1999 |
| JP | 11-318058 | | 11/1999 |
| JP | 2000-150100 | | 5/2000 |
| JP | 2000-156955 | | 6/2000 |

(Continued)

OTHER PUBLICATIONS

Ichiki Toshinobu, "Theory and Practice of Carbon Brushes", 1978, cover page, pp. i-ix and pp. 2-7, partial translation of sections 1.2 Brush Species and 1.3.1 Production of Carbon Brushes, *Corona Publishing Co., Ltd.*, Tokyo, Japan.

*Primary Examiner*—Tran Nguyen
(74) *Attorney, Agent, or Firm*—The Webb Law Firm

(57) ABSTRACT

A commutator is provided which can be produced at low cost and is excellent in wear resistance and can be used in the fuel pump. The commutator is one in which at least those portions which come into contact with brushes comprise a filler mainly consisting of coke, and a carbonized binder.

5 Claims, 3 Drawing Sheets

FOREIGN PATENT DOCUMENTS

| | | |
|---|---|---|
| JP | 2001-045716 | 2/2001 |
| JP | 2001-359258 | 12/2001 |
| JP | 2002-027710 | 1/2002 |
| JP | 2002-064958 | 2/2002 |
| JP | 2002-142410 | 5/2002 |
| JP | 02002142410 A * | 5/2002 |
| JP | 2002-315265 | 10/2002 |
| JP | 2002-369454 | 12/2002 |
| JP | 2003-212679 | 7/2003 |
| WO | WO 99/08367 | 2/1999 |
| WO | WO 99/18637 | 4/1999 |
| WO | WO 99/57797 | 11/1999 |

* cited by examiner

COMMUTATOR

FIELD OF THE INVENTION

This invention relates to a commutator, in particular a commutator for use in the fuel pump.

BACKGROUND OF THE INVENTION

Fuel pumps have so far been widely used in internal combustion engines of automobiles, among others. When brushes slidingly come into contact with a plurality of divided contacting portions of the commutator in the motor section, electric current flows from a power supply source to the armature windings, and the armature turns. As a result of the rotation of this armature, the impeller in the pump section rotates, and the fuel is sucked up from the fuel tank and fed to an internal combustion engine.

The commutator is generally made of copper. When the brushes, which slidingly come into the copper-made contacting portions, are soft, the brushes will wear quickly, hence the life thereof will be shortened. For example, it is conceivable to form the brushes out of a carbon material comprising amorphous carbon, which is high in hardness, to thereby improve the wear resistance of the brushes. However, the copper-made contacting portions may be corroded as a result of their reaction with an oxidized fuel or sulfur component-containing fuel, for instance. Further, copper sulfide, which is electrically conductive, may be formed, possibly resulting in electric connection between two neighboring contacting portions out of the plurality of divided contacting portions. For preventing the contacting portions from reacting with the fuel, it is known in the art that the contacting portions be made of a carbon material, as disclosed in U.S. Pat. No. 5,175,463.

However, the contacting portions made of a carbon material are low in hardness and inferior in mechanical strength as compared with contacting portions made of copper, so that there arise problems, namely when the contacting portions made of a carbon material slidingly contact with the brushes made of an amorphous carbon-containing material, the contacting portions are worn at an increased rate and the life of the contacting portions until reaching the tolerance limit of wear becomes shortened. An attempt has been made to prolong the life of contacting portions by using artificial graphite, which is higher in hardness than natural graphite, as the carbon material for making contacting portions. However, there arises another problem, namely the production cost increases since artificial graphite is expensive as compared with natural graphite.

Thus, it has been disclosed in Japanese Patent Laid-Open Application (JP Kokai) H10(1998)-162923 to add 5 to 30% by weight of amorphous carbon to natural graphite.

However, when natural graphite is used as the key material, the life of commutators is limited. Further, in view of the increasing trend in recent years toward cost reduction, it is difficult to manufacture commutators having satisfactory characteristics using natural graphite as the key material while meeting the cost reduction requirement.

Accordingly, it is an object of the present invention to provide a commutator which is excellent in wear characteristics and can be manufactured at low cost and can be used in fuel pumps.

SUMMARY OF THE INVENTION

In accordance with the present invention, the above object can be accomplished by providing a commutator in which at least those portions which come into contact with brushes comprise a filler mainly consisting of coke, and a carbonized binder. Preferably, the content of coke in the filler amounts to higher than 30% by weight but not higher than 80% by weight, with the balance being natural graphite, artificial graphite or a mixture of natural graphite and artificial graphite. Further, the resistivity of the commutator in the direction perpendicular to the direction of pressure application is preferably not lower than 10 μΩ·m but not higher than 95 μΩ·m as measured by the voltage drop method.

The term "carbonized" as used herein means that the binder has been subjected to heat treatment at 400° C. or above. It is possible to make further improvements in wear resistance by incorporating or adding carbon fibers or a solid lubricant such as molybdenum disulfide or tungsten disulfide in or to the filler-binder mixture.

The coke which is to serve as the main filler component is inexpensive as compared with natural graphite or artificial graphite, hence is conducive to reduction in manufacturing cost. When the filler is constituted of a mixture composed of more than 30% by weight but not more than 80% by weight of coke and, for the remainder, natural graphite, artificial graphite or a mixture of natural graphite and artificial graphite, the contacting portions to come into contact with carbon brushes will not become excessively hard or the commutator wear will not become remarkable. Further, by using coke as the main component, the commutator as a whole becomes highly resistive and improved in commutation characteristics. In addition, since coke particles are hard, the brush surface is always maintained in a constantly flat condition and, therefore, the surface change with lapse of time is slight and the sliding motion is stabilized and high levels of efficiency can be maintained for a prolonged period of time. As for the binder, such a binding agent as pitch, or a thermosetting resin, for example a phenol resin, is used. The commutator of the invention may also have a double-layer structure built up by monolithic molding of a metal (e.g. brass)-based powder used for forming the non-contacting side of the commutator and a carbon-binder composite powder for forming the contacting side.

The commutator of the invention, which is constituted of a coke-based filler and a binder, as mentioned above, can be manufactured at reduced production cost and can show improved durability and good characteristics over a prolonged period of time.

DETAILED DESCRIPTION OF THE INVENTION

Figure 1:
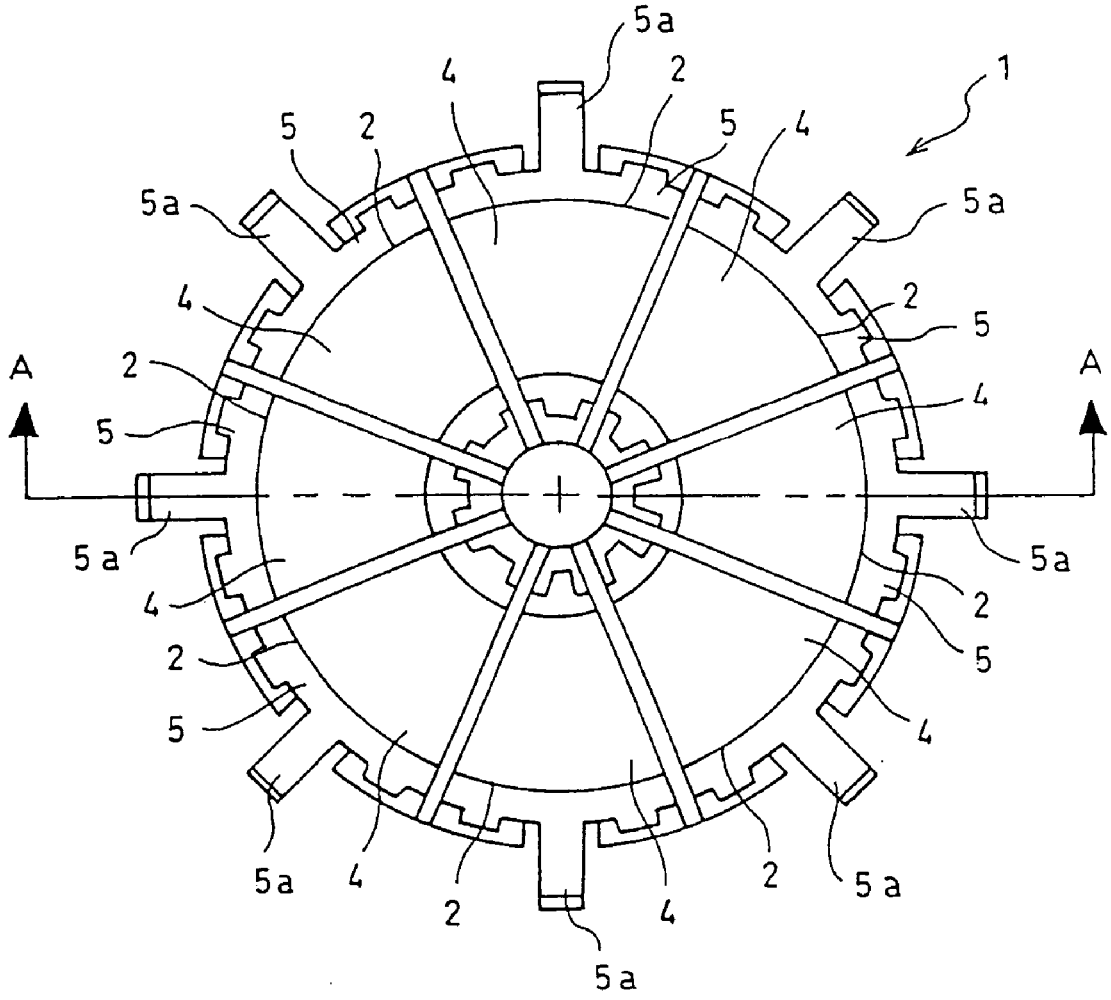
FIG. 1 is a plan of a commutator according to an embodiment of the present invention.
Figure 2:
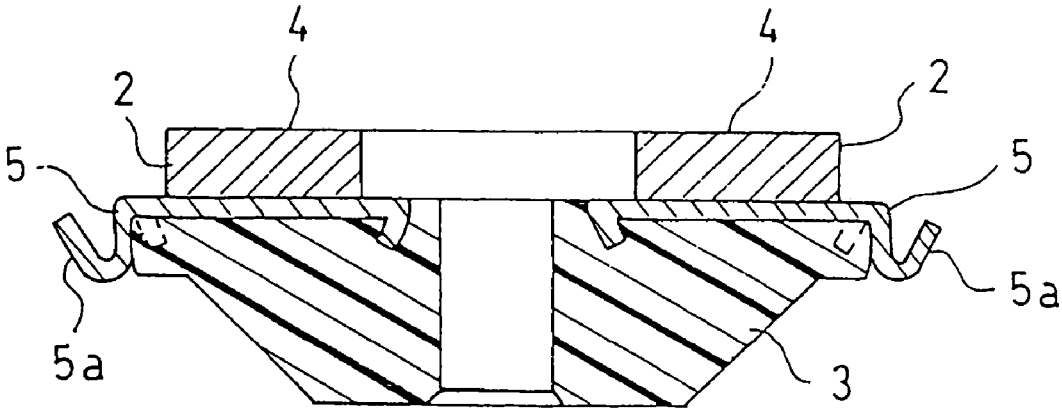
FIG. 2 is a cross section along the line A—A in FIG. 1.

Now, referring to the accompanying drawings, an embodiment of the commutator of the invention is described more specifically. As shown in FIG. 1 and FIG. 2, the commutator 1 according to this embodiment is constituted of eight segments 2 dividedly disposed at even angular intervals and a resin-made supporting member 3 for supporting the segments 2. Each segment 2 comprises a contacting portion 4 and a copper-made terminal portion 5 electrically connected with the contacting portion 4. The groove separating each pair of neighboring segments 2 from each other extends to the supporting member 3, so that the segments 2 are electrically insulated from one another. A claw 5*a* peripherally protrudes out of each terminal portion 5 and is electrically connected with a coil.

The commutator 1 constituted in that manner is produced in the following manner.

First, that end face of an undivided contacting portion 2 which is to come into contact with an undivided terminal portion 5 is plated with nickel, and the nickel surface and the terminal portion 5 are soldered together. The undivided terminal portion 5 is made of copper in the shape of a disk and peripherally has claws 5*a*. The undivided contacting portion 2 is constituted of a coke-based filler and a binder, and the binder is a carbonized one. A supporting member 3 is formed on the undivided terminal portion 5 by molding a resin and, then, the contacting portion 2 and terminal portion 5 are divided into segments so that the groove between each pair of neighboring segments may extend to that supporting member 3, whereby contacting portions 62 and terminal portions 63 are formed. Thereafter, each contacting portion 2 after division is electrically connected with a coil by fusing the coil to the claw 5*a* belonging to that contacting portion.

In the above process, the filler, which constitutes the undivided contacting portion 2, comprises more than 30% by weight but not more than 80% by weight, preferably more than 40% by weight but not more than 70% by weight, of coke, with the balance being natural graphite, artificial graphite or a mixture of natural graphite and artificial graphite. The undivided contacting portion 2 is formed by molding a composition prepared by mixing the above coke-graphite mixture with a thermosetting resin, for example a phenol resin, as a binder, into a predetermined form and shape, followed by carbonization of the binder by burning at 700–900° C. in a non-oxidizing atmosphere. The use of coke as the main component results in an increase in contact resistance of the commutator as a whole and in improvements in commutation performance characteristics. In addition, since coke particles are hard, the brush faces are always maintained in a constant surface condition and, therefore, the wear is slight, the sliding motion is stabilized and high efficiency levels can be maintained for a long period of time.

EXAMPLE 1

Figure 3:
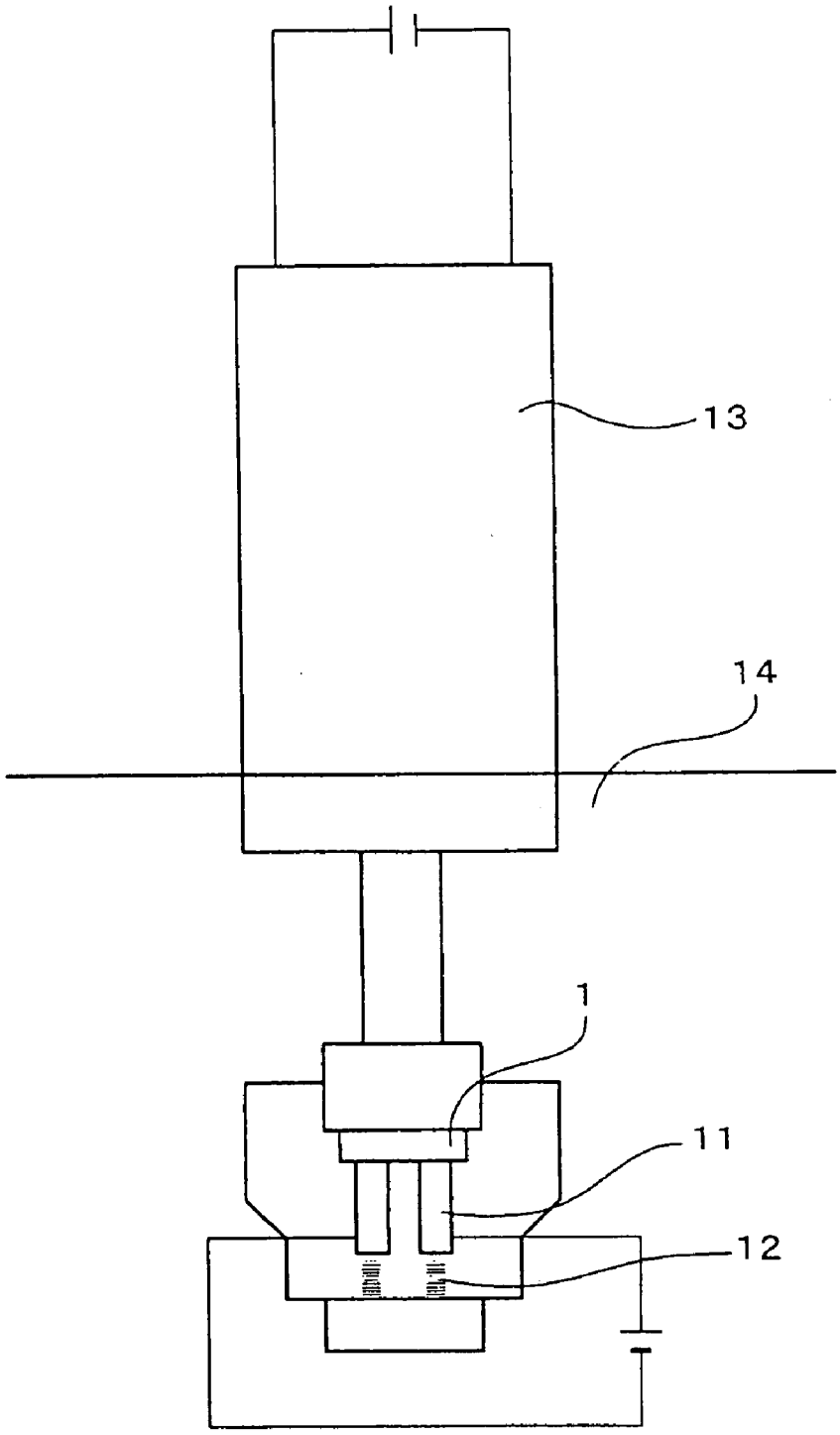
FIG. 3 is a schematic representation of an apparatus for testing the commutator according to the invention.

Petroleum-derived calcined coke (50% by weight), natural graphite (50% by weight) and a phenol resin were mixed together and kneaded. After kneading, the kneaded mixture was dried and ground to an average particle size of 100 μm or smaller. The resulting powder was molded into a shape shown in FIG. 1 and FIG. 2 to give a commutator. This commutator was measured for resistivity and, further, placed on a testing apparatus as shown in FIG. 3 and measured for commutator wear rate. The resistivity reported herein is the value in the direction perpendicular to the direction of pressure application as measured by the voltage drop method. More specifically, a copper net to serve as a current terminal was applied to each of both end faces of the test specimen, an electric current was carried to the test specimen while applying a pressure of about 1 kg thereto via an insulating material, and the voltage drop in the middle of the test specimen was measured using a voltmeter.

The testing apparatus shown in FIG. 3 is constituted of a motor 13 with the test specimen commutator 1 mounted at the shaft tip thereof, a pair of carbon brushes 11 contacting with the commutator 1, and a pair of springs 12 for pushing the carbon brushes 11 against the commutator 1. The commutator wear rate was determined under the following conditions in an atmosphere of a petroleum-derived mineral oil 14 on the assumption that the commutator was actually used in a fuel pump.

Number of revolutions: 10,000 $min^{-1}$;

Commutator: ø 20 mm;

Electric current: D.C. 5 A;

Peripheral velocity: 10 (m/sec).

EXAMPLE 2

A commutator was manufactured in the same manner as in Example 1 except that the petroleum-derived calcined coke was used in a proportion of 70% by weight and natural graphite in a proportion of 30% by weight. The commutator was measured for resistivity and commutator wear rate.

EXAMPLE 3

A commutator was manufactured in the same manner as in Example 1 except that the petroleum-derived calcined coke was used in a proportion of 80% by weight and natural graphite in a proportion of 20% by weight. The commutator was measured for resistivity and commutator wear rate.

EXAMPLE 4

A commutator was manufactured in the same manner as in Example 1 except that the petroleum-derived calcined coke was used in a proportion of 35% by weight and natural graphite in a proportion of 65% by weight. The commutator was measured for resistivity and commutator wear rate.

COMPARATIVE EXAMPLE 1

A commutator was manufactured in the same manner as in Example 1 except that the petroleum-derived calcined coke was used in a proportion of 30% by weight and natural graphite in a proportion of 70% by weight. The commutator was measured for resistivity and commutator wear rate.

COMPARATIVE EXAMPLE 2

A commutator was manufactured in the same manner as in Example 1 except that the petroleum-derived calcined coke was used in a proportion of 85% by weight and natural graphite in a proportion of 15% by weight. The commutator was measured for resistivity and commutator wear rate.

COMPARATIVE EXAMPLE 3

A commutator was manufactured in the same manner as in Example 1 except that the petroleum-derived calcined coke was used in a proportion of 100% by weight. The commutator was measured for resistivity and commutator wear rate.

COMPARATIVE EXAMPLE 4

A commutator was manufactured using 100% by weight of natural graphite as the filler. The commutator was measured for resistivity and commutator wear rate.

The resistivity and commutator wear rate data obtained for the commutators of Examples 1 to 4 and Comparative Examples 1 to 4 are summarized in Table 1.

TABLE 1

| | Coke (wt %) | Natural graphite (wt %) | Resistivity (μΩ m) | Commutator wear rate (mm/1000 h) | Brush wear rate (mm/1000 h) |
|---|---|---|---|---|---|
| Example 1 | 50 | 50 | 46 | 0.2 | 0.2 |
| Example 2 | 70 | 30 | 75 | 0.2 | 0.3 |
| Example 3 | 80 | 20 | 81 | 0.3 | 0.3 |
| Example 4 | 35 | 65 | 39 | 0.3 | 0.3 |
| Comparative Example 1 | 30 | 70 | 33 | 0.4 | 0.4 |
| Comparative Example 2 | 85 | 15 | 92 | 0.4 | 0.6 |
| Comparative Example 3 | 100 | 0 | 121 | 0.5 | 1.0 |
| Comparative Example 4 | 0 | 100 | 15 | 1.0 | 0.6 |

The data shown in Table 1 indicate that as the coke content increases, the resistivity increases. It is also indicated that as the coke content increases from 30% by weight, the commutator wear rate and brush wear rate each once decreases and then increases. Thus, by selecting the coke content within the range of from more than 30% by weight to 80% by weight, it becomes possible to provide commutators capable of maintaining their excellent characteristics over a prolonged period of time.

What is claimed is:

1. A commutator in which at least those portions which come into contact with brushes comprise a filler mainly consisting of coke, and a carbonized binder, wherein the resistivity of the commutator in a direction perpendicular to a direction of pressure application is not lower than 10 μΩ·m but not higher than 95 μΩ·m as measured by a voltage drop method.

2. A commutator according to claim 1, wherein the content of coke in the filler amounts to higher than 30% by weight but not higher than 80% by weight, with the balance being natural graphite, artificial graphite or a mixture of natural graphite and artificial graphite.

3. A commutator in which at least those portions which come into contact with brushes comprise a filler consisting of coke, and a carbonized binder, wherein the resistivity of the commutator in a direction perpendicular to a direction of pressure application is not lower than 10 μΩ·m but not higher than 95 μΩ·m as measured by a voltage drop method.

4. A commutator according to claim 1, wherein said binder is carbonized at 400–900° C.

5. A commutator according to claim 3, wherein said binder is carbonized at 400–900° C.

* * * * *